US010753178B2

(12) United States Patent
Bigrigg et al.

(10) Patent No.: US 10,753,178 B2
(45) Date of Patent: Aug. 25, 2020

(54) METHOD FOR REMOVING A DOWNHOLE PLUG

(71) Applicants: Scott A. Bigrigg, Pittsburgh, PA (US); Bryan J. Sims, Flemington, WV (US)

(72) Inventors: Scott A. Bigrigg, Pittsburgh, PA (US); Bryan J. Sims, Flemington, WV (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 137 days.

(21) Appl. No.: 15/635,952

(22) Filed: Jun. 28, 2017

(65) Prior Publication Data

US 2019/0003286 A1 Jan. 3, 2019

(51) Int. Cl.

| | |
|---|---|
| ***E21B 43/08*** | (2006.01) |
| ***E21B 37/00*** | (2006.01) |
| ***E21B 33/134*** | (2006.01) |
| ***E21B 21/00*** | (2006.01) |
| ***E21B 34/06*** | (2006.01) |
| ***E21B 29/00*** | (2006.01) |
| ***E21B 43/10*** | (2006.01) |
| *E21B 34/00* | (2006.01) |

(52) U.S. Cl.

CPC ..... *E21B 37/00* (2013.01); *E21B 21/00* (2013.01); *E21B 29/00* (2013.01); *E21B 33/134* (2013.01); *E21B 34/06* (2013.01); *E21B 43/08* (2013.01); *E21B 43/10* (2013.01); *E21B 2034/005* (2013.01)

(58) Field of Classification Search

CPC ..... E21B 43/08–088

See application file for complete search history.

(56) References Cited

U.S. PATENT DOCUMENTS

| | | | | | |
|---|---|---|---|---|---|
| 5,174,379 | A * | 12/1992 | Whiteley | E21B 43/045 | 166/126 |
| 5,320,178 | A * | 6/1994 | Cornette | E21B 7/00 | 166/278 |
| 5,662,170 | A * | 9/1997 | Donovan | E21B 23/00 | 166/278 |
| 5,749,419 | A * | 5/1998 | Coronado | E21B 23/06 | 166/120 |
| 5,842,528 | A * | 12/1998 | Johnson | E21B 4/02 | 175/45 |
| 7,108,083 | B2 * | 9/2006 | Simonds | E21B 7/20 | 166/227 |
| 9,863,213 | B1 * | 1/2018 | Kellam | E21B 31/18 | |
| 2008/0179065 | A1 * | 7/2008 | Vincent | E21B 10/02 | 166/387 |
| 2013/0112412 | A1 * | 5/2013 | Frazier | E21B 33/134 | 166/298 |
| 2014/0041876 | A1 * | 2/2014 | Fleckenstein | E21B 34/08 | 166/306 |
| 2014/0116705 | A1 * | 5/2014 | Broussard | E21B 37/00 | 166/305.1 |
| 2018/0156011 | A1 * | 6/2018 | Eidem | E21B 43/086 | |

* cited by examiner

*Primary Examiner* — Kipp C Wallace

(74) *Attorney, Agent, or Firm* — Cantor Colburn LLP

(57) ABSTRACT

A method of cleaning out a wellbore includes removing the downhole zonal isolation device arranged in a wellbore with a bottom hole assembly (BHA) of a downhole string formed from a plurality of tubulars, pumping off the BHA, removing downhole fluids from the wellbore without removing the downhole string following pumping off the BHA, circulating fluid near a toe of the wellbore, and removing downhole particles from the wellbore through the downhole string.

12 Claims, 5 Drawing Sheets

METHOD FOR REMOVING A DOWNHOLE PLUG

BACKGROUND

In the drilling and completion industry boreholes are formed to provide access to a resource bearing formation. Occasionally, it is desirable to install a plug in the borehole in order to isolate a portion of the resource bearing formation. When it is desired to access the portion of the resource bearing formation to begin production, a drill string is installed with a bottom hole assembly including a bit or mill. The bit or mill is operated to cut through the plug. After cutting through the plug, the drill string is removed and a production string is run downhole to begin production. Withdrawing and running-in strings including drill strings and production strings is a time consuming and costly process.

SUMMARY

Disclosed is a method of cleaning out a wellbore including removing the downhole zonal isolation device arranged in a wellbore with a bottom hole assembly (BHA) of a downhole string formed from a plurality of tubulars, pumping off the BHA, removing downhole fluids from the wellbore without removing the downhole string following pumping off the BHA, circulating fluid near a toe of the wellbore, and removing downhole particles from the wellbore through the downhole string.

BRIEF DESCRIPTION OF THE DRAWINGS

Referring now to the drawings wherein like elements are numbered alike in the several Figures.

DETAILED DESCRIPTION

A detailed description of one or more embodiments of the disclosed apparatus and method are presented herein by way of exemplification and not limitation with reference to the Figures.

Figure 1:
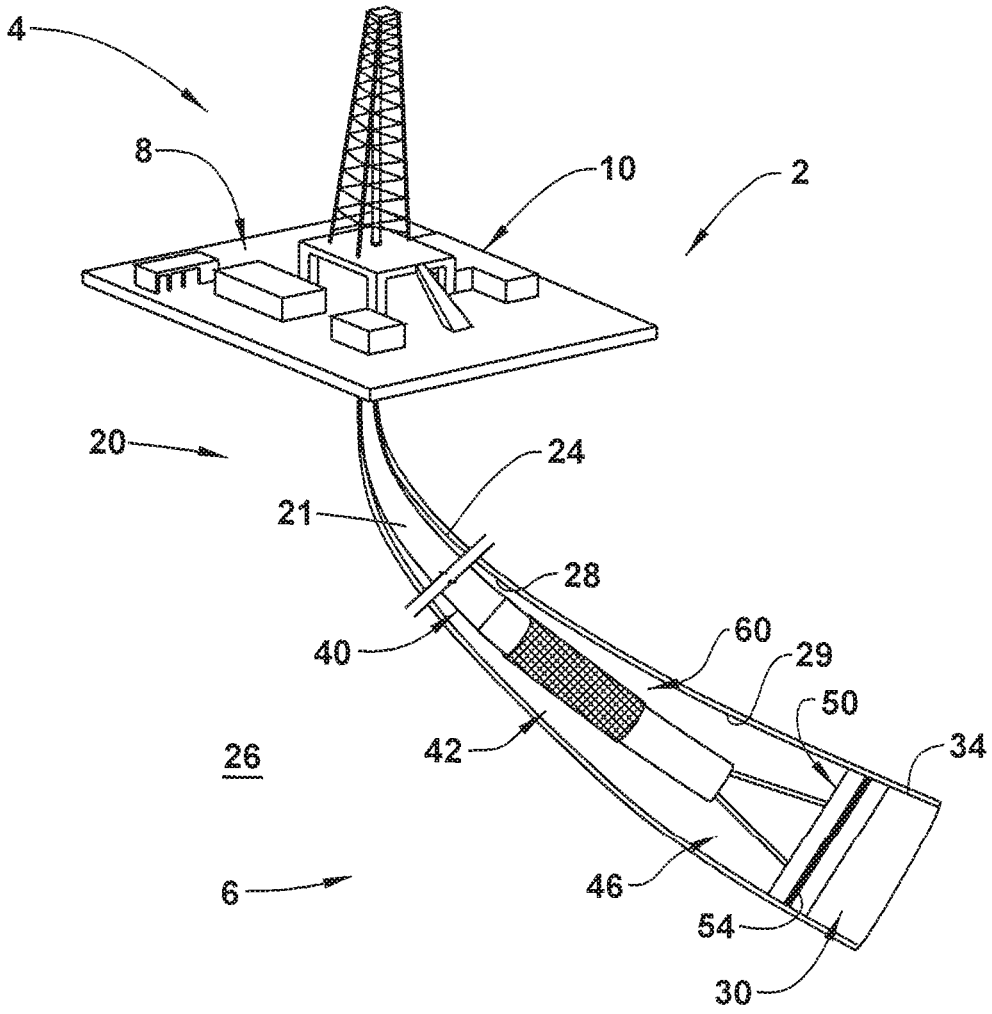
FIG. 1 depicts a resource exploration and recovery system including a plug removal and production system, in accordance with an exemplary embodiment.

A resource exploration and recovery system, in accordance with an exemplary embodiment, is indicated generally at 2, in FIG. 1. Resource exploration and recovery system 2 should be understood to include well drilling operations, resource extraction and recovery, $CO_2$ sequestration, and the like. Resource exploration and recovery system 2 may include a surface system 4 operatively connected to a downhole system 6. Surface system 4 may include pumps 8 that aid in completion and/or extraction processes as well as fluid storage 10. Fluid storage 10 may contain a gravel pack fluid or slurry (not shown) or other fluid which may be introduced into downhole system 6.

Downhole system 6 may include a downhole string 20 formed from a plurality of tubulars, one of which is indicated at 21 that is extended into a wellbore 24 formed in formation 26. Wellbore 24 includes an annular wall 28 that may be defined by a wellbore casing 29 provided in wellbore 24. Of course, it is to be understood, that annular wall 28 may also be defined by formation 26. In the exemplary embodiment shown, downhole system 6 may include a downhole zonal isolation device 30 that may form a physical barrier between one portion of formation 26 and another portion of formation 26. Downhole zonal isolation device 30 may take the form of a bridge plug 34. Bridge plug 34 may be formed from cast iron sealingly engaged with annular wall 28. Of course, it is to be understood that zonal isolation device 30 may take on various forms including frac plugs formed from composite materials and or metal, sliding sleeves and the like.

In further accordance with an exemplary embodiment, downhole string 20 defines a drill string 40 including a plug removal and production system 42. Plug removal and production system 42 is arranged at a terminal end portion (not separately labeled) of drill string 40. Plug removal and production system 42 includes a bottom hole assembly (BHA) 46 having a plug removal member 50 which may take the form of a bit or a mill 54. Of course, it is to be understood that plug removal member 50 may take on various forms such as a mill or a bit. BHA 46 may take on a variety of forms known in the art.

Figure 2:
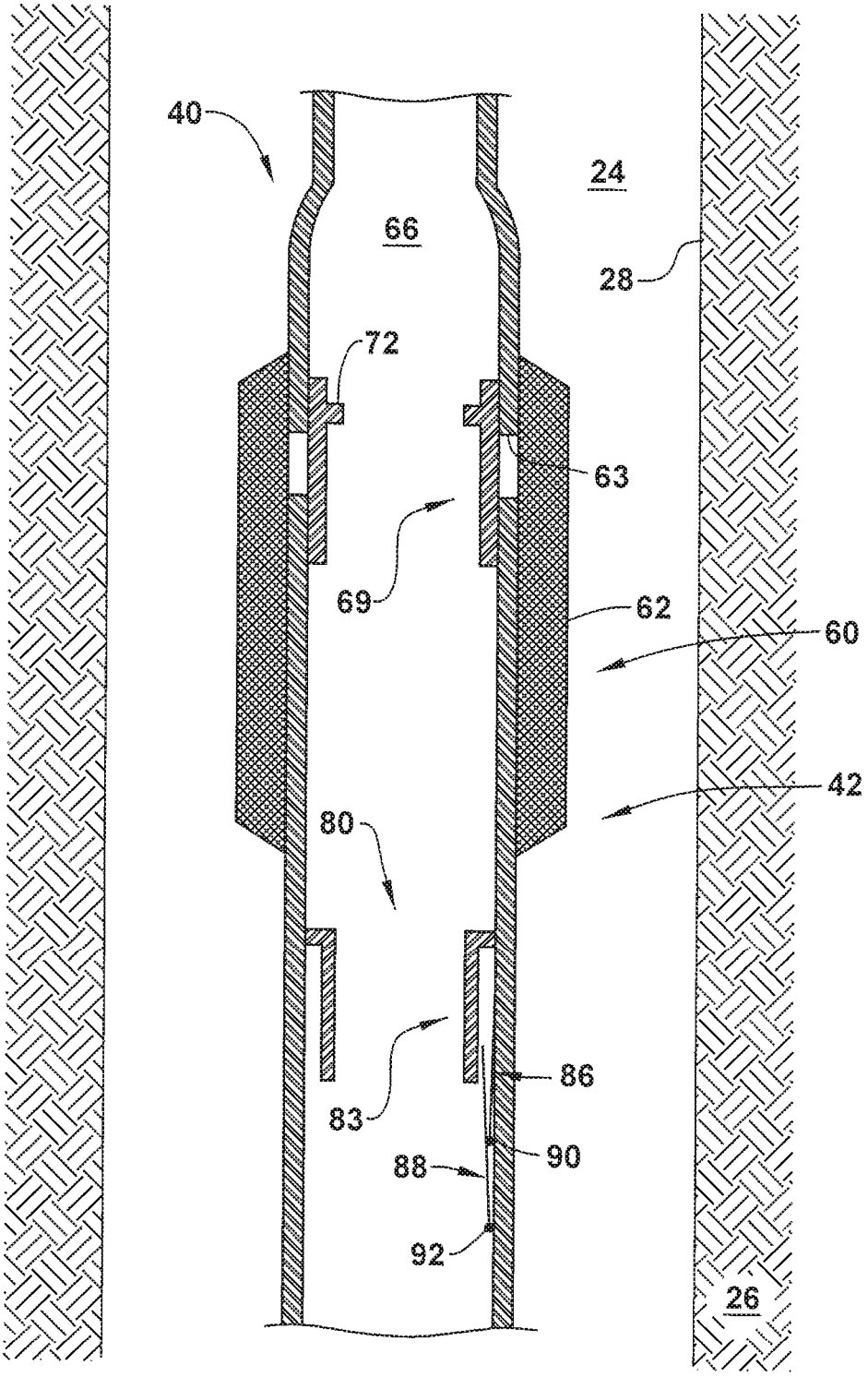
FIG. 2 depicts the plug removal and production system with a selective sand screen in a closed configuration, in accordance with an aspect of an exemplary embodiment.

In still further accordance with an exemplary embodiment illustrated in FIG. 2 and with continued reference to FIG. 1, plug removal and production system 42 includes a selective sand screen 60 arranged uphole of BHA 46. Selective sand screen 60 includes a screen element 62 that is arranged over a plurality of openings, one of which is shown at 63, formed in drill string 40. It is to be understood that the number of screen elements may vary. Further, it is to be understood that screen opening size may vary. It is also to be understood that screen element 62 may include a number of screen layers. Openings 63 fluidically connect wellbore 24 with a flow path 66 extending through drill string 40. Selective sand screen 60 includes a valve member 69 having a valve seat 72 that is selectively positionable over openings 63.

In yet still further accordance with an exemplary embodiment, plug removal and production system 42 includes a selective back pressure valve (BPV) 80 arranged downhole of selective sand screen 60. Selective BPV 80 includes a valve actuator 83 that is slidingly mounted to drill string 40. Valve actuator 83 selectively captures a first flapper 86 and a second flapper 88. First flapper 86 is pivotally mounted to drill string 40 through a first hinge 90. Second flapper 88 is arranged downhole of first flapper 86 and is pivotally mounted to drill string 40 through a second hinge 92. First and second flappers 86 and 88 are selectively positionable to selectively open and close off flow path 66 from downhole fluids.

In accordance with an exemplary aspect, drill string 40 is run into wellbore 24 to a selected depth at which downhole zonal isolation device 30 may be located. During run in, valve member 69 covers openings 63 and first and second flappers 86 and 88 of selective BPV 80 may be closed. BHA 46 is activated such that [drill] bit or mill? 54 engages with and removes downhole zonal isolation device 30. It should also be understood that removing downhole zonal isolation device 30 may include a milling operation or the like. Once removed, first and second flappers 86 and 88 may be opened and BHA 46 is pumped off of drill string 40. BHA 46 may rest at a toe (not separately labeled) of wellbore 24. BHA 46 may be abandoned downhole or later retrieved.

Figure 3:
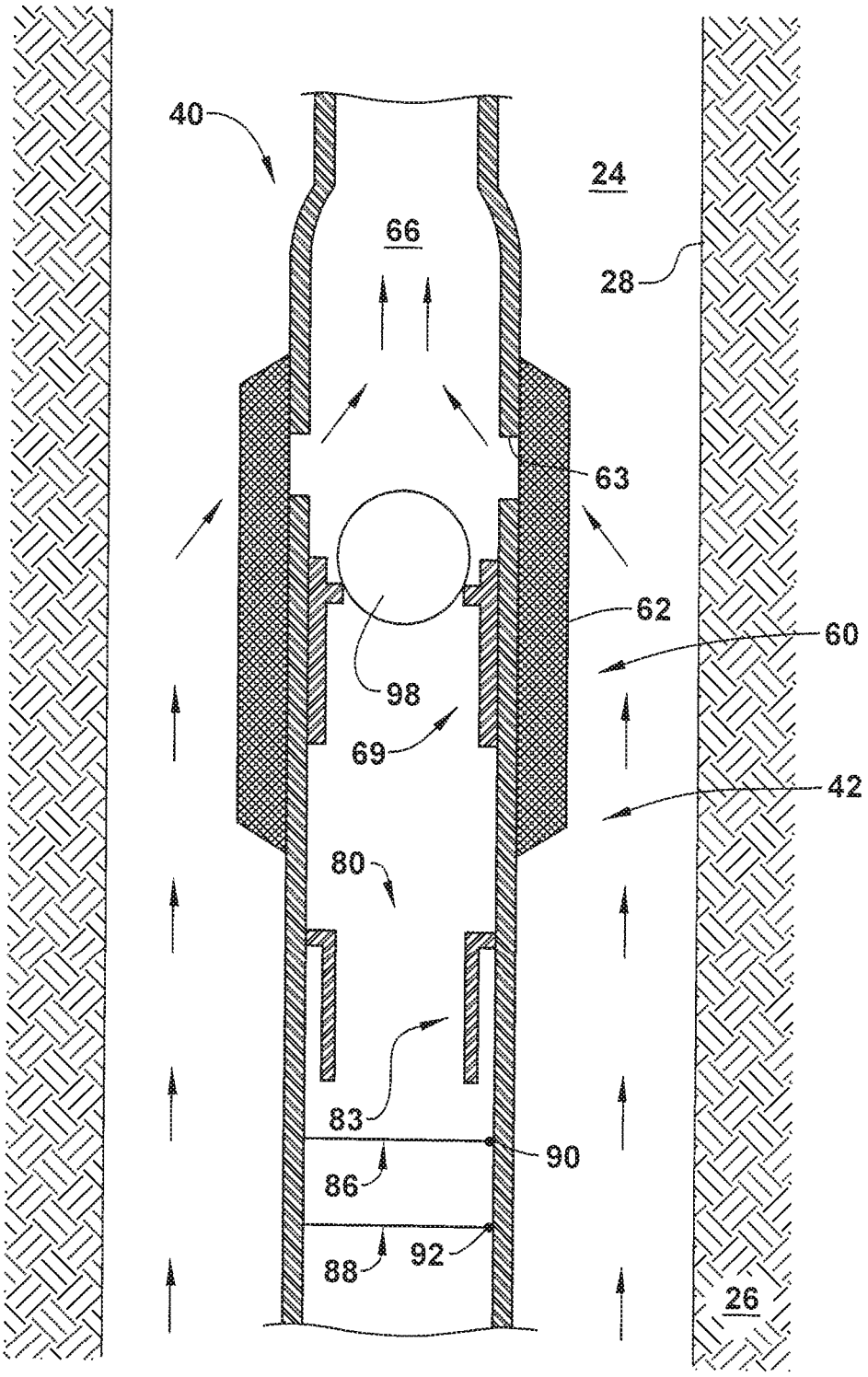
FIG. 3 depicts the plug removal and production system in a production configuration with selected sand screen being open, in accordance with an aspect of an exemplary embodiment.

Once BHA 46 is pumped off, drill string 40 may be moved uphole and hung at a selected depth. Once in position, selective sand screen 60 may be opened. In the exemplary aspect shown in FIG. 3, a drop ball 98 is introduced into drill string 40 and pumped down to valve seat 72. An application of fluid pressure urges drop ball 98 against valve seat 72 causing valve member 69 to shift thereby exposing flow path 66 to wellbore 24 through openings 63. Of course, it is to be understood that valve member 69 may be actuated through a variety of methods including mechanical methods such as introducing a shifting tool into drill string 40 or electronic methods such as electrically operated valves, magnetic locks, through the use of pressure differential valves and the like. First and second flappers 86 and 88 may be closed and fluid allowed to pass in an uphole direction along flow path 66.

Figure 4:
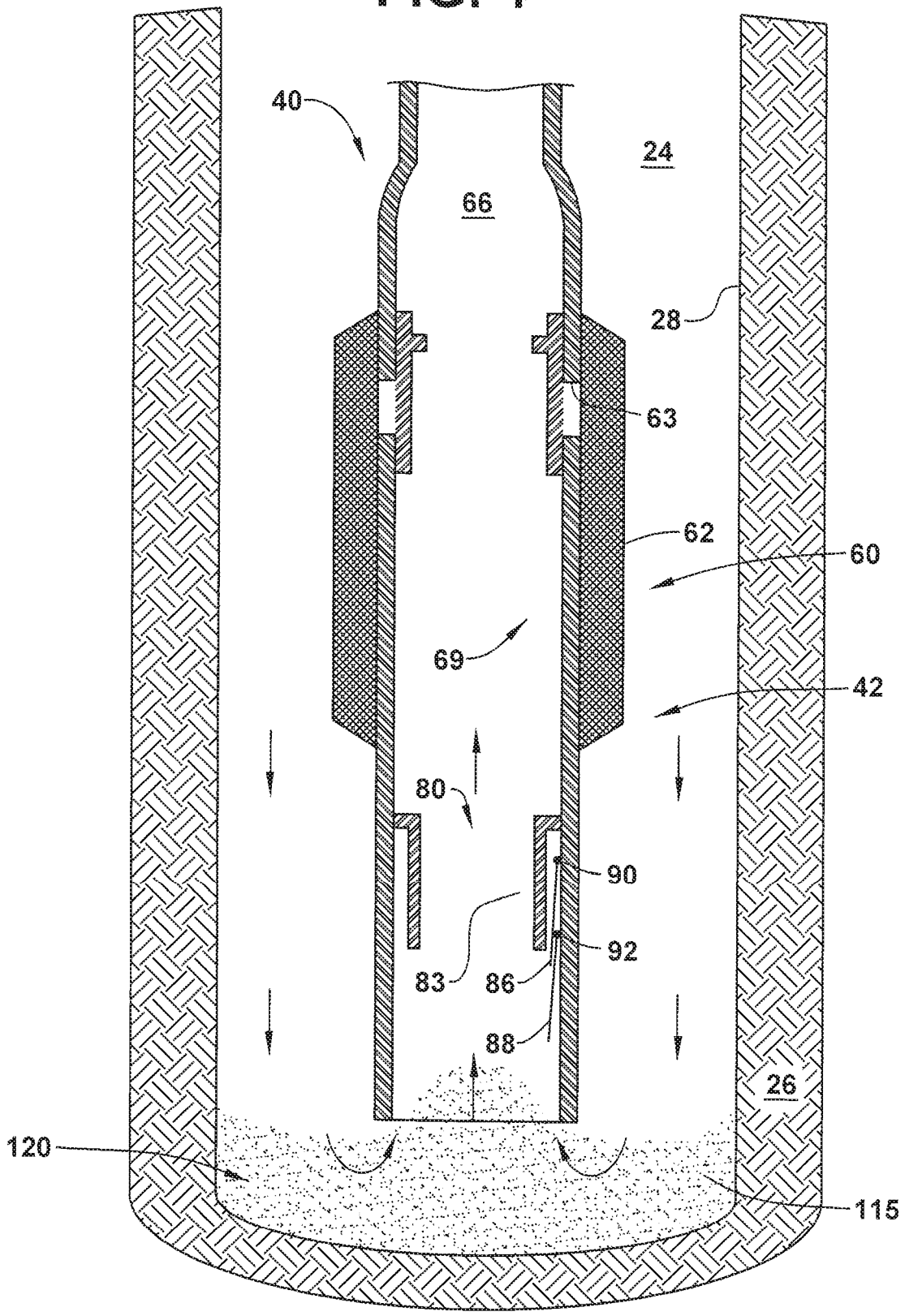
FIG. 4 depicts a reverse circulation flow portion of a wellbore cleanout operation, in accordance with an aspect of an exemplary embodiment.

After a period of time producing fluids from wellbore 24, sand and other particulates 115 may accumulate at a terminal end or toe 120. It may be desirable to remove the particulate 115 in order to enhance production. In accordance with an exemplary aspect, when it is desirable to perform a wellbore clean out, downhole string 20 is shifted in a downhole direction toward toe 120 and BPV 80 may be opened as shown in FIG. 4. A fluid, from for example fluid storage 10, is circulated into wellbore 24 from surface system 4. The fluid passes downhole between downhole string 20 and annular wall 28. Upon reaching toe 120, the fluid agitates the particulate forming a suspension. The suspension, e.g., fluid and particulate 115 is forced into downhole string 20, through a terminal end 120 thereof and passed uphole toward surface system 4 for a selected time period.

Figure 5:
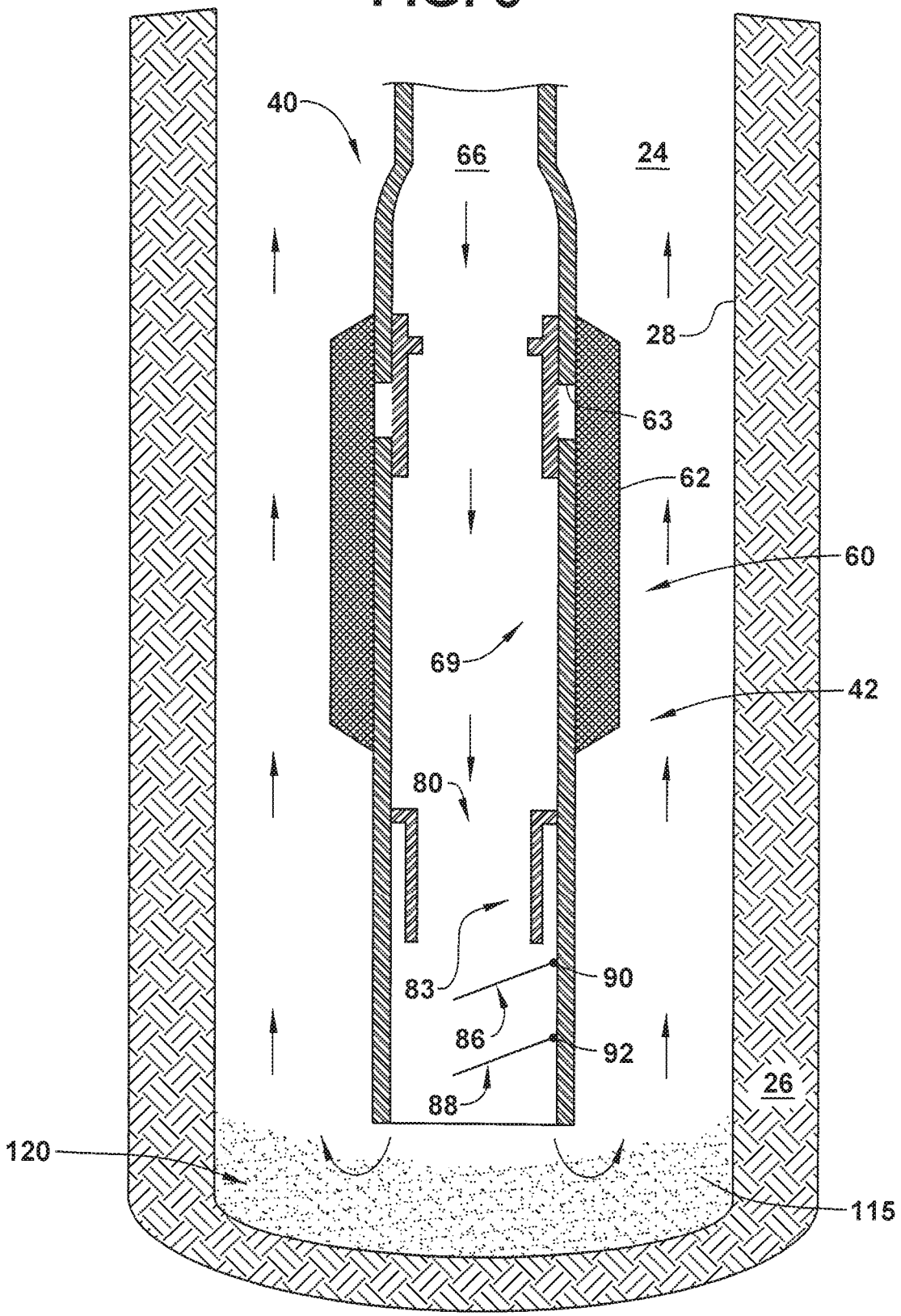
FIG. 5 depicts a standard circulation portion of the wellbore cleanout operation, in accordance with an aspect of an exemplary embodiment.

After the selected time period, fluid may be circulated downhole through downhole string 20 as shown in FIG. 5. The fluid circulating downhole removes particulate 115 that may be present in downhole string 20. Downhole string 20 may then be shifted uphole, BPV 80 closed and production allowed to resume through, for example, selective sand screen 60 after opening valve member 69. The fluid then enters flow path 66 passing through selective sand screen 60. It is to be understood that valve member 69 may be activated prior to hanging drill string 40. It is also to be understood that selective BPV 80 may be closed prior to hanging drill string 40 and/or prior to opening selective sand screen 60. The exemplary embodiments describe a method of removing a downhole zonal isolation device 30, producing through the wellbore for a period or time, cleaning out the wellbore, and resuming production all with a single downhole trip. That is, the exemplary embodiments do away with a need for multiple snubbing trips after opening the wellbore.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers, etc.

As in any prior embodiment, a method of cleaning out a wellbore comprising: removing the downhole zonal isolation device arranged in a wellbore with a bottom hole assembly (BHA) of a downhole string formed from a plurality of tubulars; pumping off the BHA; removing downhole fluids from the wellbore without removing the downhole string following pumping off the BHA; circulating fluid near a toe of the wellbore; and removing downhole particles from the wellbore through the downhole string.

As in any prior embodiment, the method of claim 1, further comprising: pulling the downhole string in an uphole direction for a selected distance, and hanging one of the plurality of tubulars in the borehole after pumping off the BHA.

As in any prior embodiment, the method of claim 2, further comprising: shifting the drill string towards the toe of the wellbore prior to circulating the fluid near the toe of the wellbore.

As in any prior embodiment, the method of claim 1, wherein removing downhole fluids from the wellbore includes opening a screen assembly and passing the downhole fluids through a screen of the screen assembly into the drill string.

As in any prior embodiment, the method of claim 1, wherein circulating fluid includes passing fluid into the wellbore toward the toe of the wellbore about the downhole string.

As in any prior embodiment, the method of claim 5, wherein passing fluid into the wellbore includes introducing the fluid into the downhole string at the toe of the wellbore.

As in any prior embodiment, the method of claim 6, wherein introducing fluid into the wellbore includes withdrawing downhole particulate from the toe of the wellbore with the fluid.

As in any prior embodiment, the method of claim 1, wherein circulating fluid includes passing fluid through the downhole string towards the toe of the wellbore.

As in any prior embodiment, the method of claim 8, wherein circulating fluid includes closing a back pressure valve arranged in the downhole string.

As in any prior embodiment, the method of claim 9, wherein closing the selective back pressure valve includes releasing a first flapper and a second flapper arranged in the drill string.

As in any prior embodiment, the method of claim 10, wherein releasing the first flapper and the second flapper includes sliding the back pressure valve in an uphole direction.

As in any prior embodiment, the method of claim 1, wherein removing the downhole zonal isolation device includes cutting through a plug.

As in any prior embodiment, the method of claim 12, wherein cutting through the plug includes cutting through a cast iron bridge plug.

The term "about" is intended to include the degree of error associated with measurement of the particular quantity based upon the equipment available at the time of filing the application. For example, "about" can include a range of ±8% or 5%, or 2% of a given value.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A method of cleaning out a wellbore comprising:

removing a downhole zonal isolation device arranged in a wellbore with a bottom hole assembly (BHA) of a downhole string formed from a plurality of tubulars, the downhole string including a backpressure valve;

pumping off the BHA;

circulating fluid into an annulus between the downhole string and the wellbore and then into the downhole string to remove downhole particles from the wellbore through the downhole string;

moving an actuator in the downhole string to close the backpressure valve; and producing downhole fluids from the wellbore through a screen assembly mounted on one of the plurality of tubulars uphole of the backpressure valve without removing the downhole string following pumping off the BHA.

2. The method of claim 1, further comprising: pulling the downhole string in an uphole direction for a selected distance and hanging one of the plurality of tubulars in the wellbore after pumping off the BHA.

3. The method of claim 2, further comprising: shifting the downhole string towards a toe of the wellbore prior to circulating the fluid near the toe of the wellbore.

4. The method of claim 1, wherein removing downhole fluids from the wellbore includes opening and passing the downhole fluids through the screen assembly into the downhole string.

5. The method of claim 1, wherein circulating fluid into the wellbore includes introducing the fluid into the downhole string at a toe of the wellbore.

6. The method of claim 5, wherein introducing fluid into the wellbore includes withdrawing downhole particulate from the toe of the wellbore with the fluid.

7. The method of claim 1, wherein circulating fluid includes passing fluid through the downhole string towards a toe of the wellbore.

8. The method of claim 7, wherein circulating fluid includes closing a back pressure valve arranged in the downhole string.

9. The method of claim 8, wherein closing the back pressure valve includes releasing a first flapper and a second flapper arranged in the downhole string.

10. The method of claim 9, wherein releasing the first flapper and the second flapper includes sliding the back pressure valve in an uphole direction.

11. The method of claim 1, wherein removing the downhole zonal isolation device includes cutting through a plug.

12. The method of claim 11, wherein cutting through the plug includes cutting through a cast iron bridge plug.

* * * * *